US005117585A

United States Patent [19]

Andrisin, III

[11] Patent Number: 5,117,585

[45] Date of Patent: Jun. 2, 1992

[54] LOCKING APPARATUS FOR USE IN ADJUSTING THE WIDTH OF A CLOSURE

[75] Inventor: John J. Andrisin, III, Seven Hills, Ohio

[73] Assignee: Century Products Company, Macedonia, Ohio

[21] Appl. No.: 745,812

[22] Filed: Aug. 16, 1991

[51] Int. Cl.[5] ..... E06B 7/00

[52] U.S. Cl. ..... 49/55; 49/57

[58] Field of Search ..... 49/50, 55, 56, 57, 463; 256/24

[56] References Cited

U.S. PATENT DOCUMENTS

| | | | |
|---|---|---|---|
| 4,465,262 | 8/1984 | Itri et al. | 49/55 X |
| 4,583,715 | 4/1986 | Wright . | |
| 4,611,431 | 9/1986 | Lauro . | |
| 4,677,791 | 7/1987 | Larson et al. | 49/55 X |
| 4,680,890 | 7/1987 | Jokel | 49/55 |
| 4,702,036 | 10/1987 | Johnson | 49/55 |
| 4,944,117 | 7/1990 | Gebhard et al. | 49/55 |
| 5,018,302 | 5/1991 | Kluge | 49/55 X |

*Primary Examiner*—Renee S. Luebke
*Assistant Examiner*—Jerry Redman
*Attorney, Agent, or Firm*—Graham & James

[57] ABSTRACT

In a gate or similar closure suitable for temporary and quick installation across a passageway comprised of a vertical barrier, frame, and pivotable gate within the frame, a locking apparatus is provided which allows quick and easy width changes of the closure within various widths of passageways. The locking apparatus does not require disassembly from the closure in order to change the width of the passage. The locking apparatus includes rail engaging hooks which wrap substantially circumferentially around the rails of the vertical barrier. The closure is braced in the passageway and locked into position by conventional clamp screws being tightened against the side walls of the passageway, thus forcing the rails into slots defined by the hooks.

7 Claims, 2 Drawing Sheets

LOCKING APPARATUS FOR USE IN ADJUSTING THE WIDTH OF A CLOSURE

BACKGROUND OF THE INVENTION

This invention relates to gates, doors and similar structures and the frames to which they are mounted. In particular, this invention relates to safety barriers for easy temporary installation across an opening such as a doorway or stairway, such barriers being the type generally used to prevent the passage of small children or animals.

U.S. Pat. No. 4,611,431, the disclosure of which is incorporated herein by reference, discusses safety barriers widely used as temporary installations in homes where infants or animals are present to prevent the infants or animals from entering a stairwell, leaving or entering a room, or similar types of access or activity. Such barriers are typically designed to be quickly installed and removed so that the restricted area can be readily shifted from one location to another and the barrier can be removed when the child or animal is not present. Since the typical home will have a number of passageways of varying widths, it is preferable to have an adjustable width closure or barrier which is readily adjustable for installation across passageways of various widths. In addition to spanning the width of the passageway, such barriers generally include a gate which is openable only by an adult to permit passage when the barrier is in place.

Another safety barrier is shown in U.S. Pat. No. 4,583,715 which also includes a pivoting gate.

The above closure mechanisms, while adequate for most purposes, have disadvantages which make their use less than ideal. The closure of U.S. Pat. 4,611,431, when tightened in the passageway, stresses the pivot hinge and bolt assembly unnecessarily, which may cause the mechanism to malfunction over extended use periods. Further, the bolt and nut assembly must be completely removed and reinstalled to adjust the closure width for varying passageway widths. The safety gate disclosed in U.S. Pat. No. 4,583,715 also has the disadvantage that the locking of relative axial movement of the gate and barrier unnecessarily stresses the locking mechanism of the gate (lock and latch 48). There is no direct connection between the rails of the gate and the rails of the barrier to prevent relative axial movement between the gate and barrier.

It would be advantageous if a closure could be designed to have a pivoting gate and gate width adjustment locking mechanisms which are uncoupled from the mechanism which secures the closure apparatus into the passageway. It would further be advantageous if the width adjustment of the closure could be performed in an uncomplicated manner.

SUMMARY OF THE INVENTION

According to the present invention, there is provided a locking apparatus for use in locking an adjustable width closure to one of a plurality of widths, the closure adapted to be mounted across a passageway with clamps. The closure on which the locking apparatus is typically used includes a vertical barrier extending laterally from a first vertical post positioned adjacent one vertical side of the passageway, and a gate extending laterally within a frame, the frame including a second vertical post positioned adjacent a second vertical side of the passageway. The vertical barrier and gate each have a plurality of vertical rails. The closure incorporating the locking apparatus of the present invention is rigidly secured in a passageway by known means, such as the conventional pair of clamp screws which laterally pass through one of the two vertical posts.

The locking apparatus comprises a body attached to the closure and a plurality of means for engaging at least one rail, the means extending from the body substantially perpendicular to said rails and engaging at least one of the rails of the vertical barrier and gate. In one preferred embodiment, the body is fixed in spaced relation to the rails of either the vertical barrier on the gate by attachment means fastened to a lower horizontal arm of either the frame or vertical barrier, as further described herein.

The locking apparatus of the present invention has numerous advantages over prior art locking mechanisms. The locking apparatus does not have to be completely detached from the closure by removing screws or bolts to adjust the width of the closure. In one preferred embodiment, the plurality of means for engaging comprises a plurality of hooks defining slots to engage a longitudinal portion of one of the rails, the hooks extending from the body of the locking apparatus. The slots have size and shape to accept the rails of the closure apparatus when the gate and barrier are forced together with oppositely directed forces and the slots created by the hooks prevent the rails from slipping out of the locking apparatus when the closure is expanded (by the action of the clamps) into the passageway.

Further improvements, advantages, embodiments and aspects of the invention will become apparent from the description which follows.

DESCRIPTION OF PREFERRED EMBODIMENTS

Figure 1:
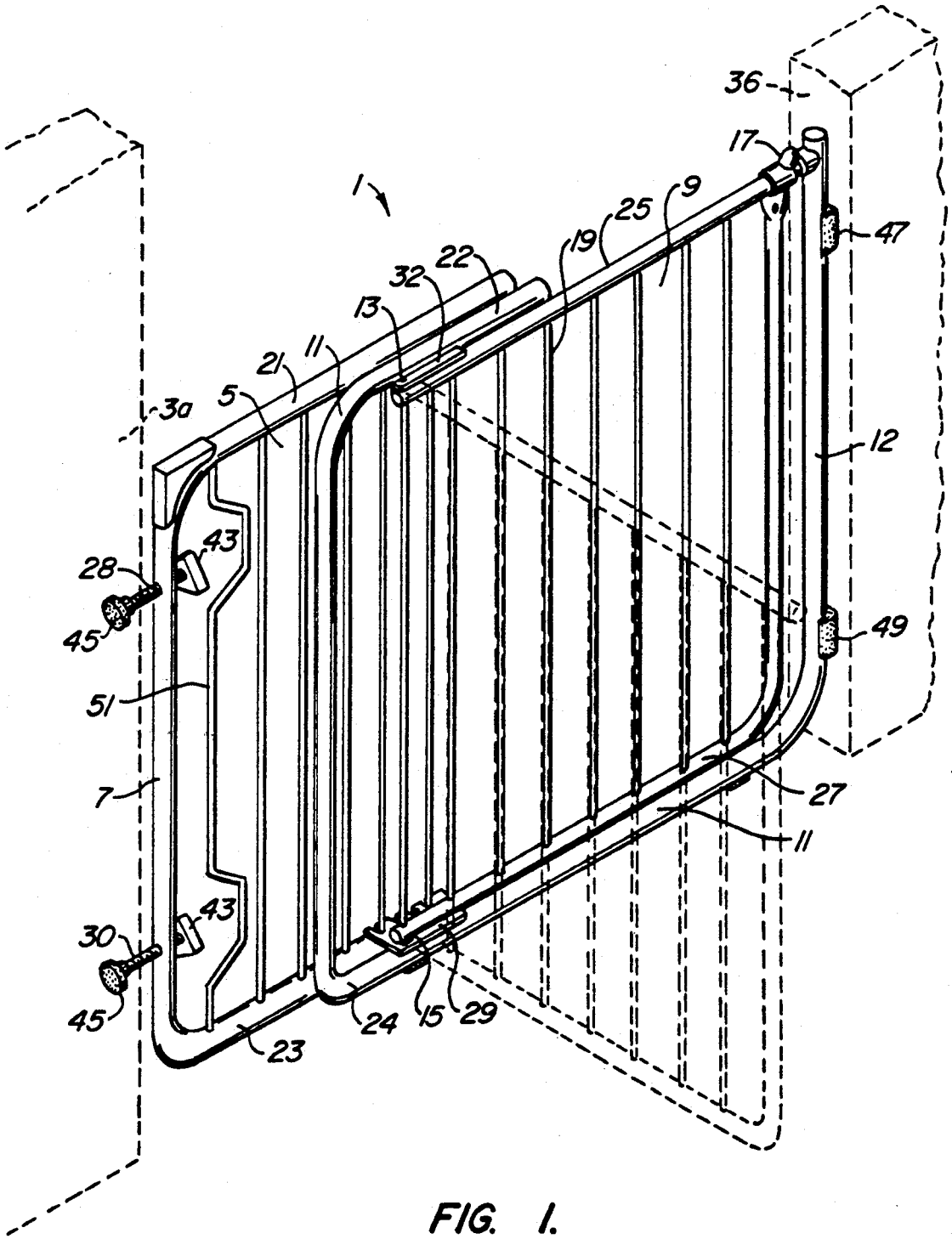
FIG. 1 is a perspective view of a closure secured to a passageway, the closure including one embodiment of the locking apparatus described herein.

The locking apparatus of the invention can be specifically described in reference to the figures of the attached drawing. FIG. 1 illustrates a passageway closure 1 utilizing the locking apparatus of the present invention. Passageway closure 1 is shown secured between vertical opposing sides 3*a*, b of a passageway. A vertical barrier 5 extends laterally from a vertical post 7, and, together with gate 9, prevents an animal or child from passing through the passageway. The structure supporting gate 9 includes a frame 11, the frame including a vertical post 12 adjacent to side 3*b* of the passageway, upper horizontal arm 22 and lower horizontal arm 24. Gate 9 pivots to the open position (shown in phantom in FIG. 1) by pivoting at pivot points 13 and 15. In the closed position, an appropriate lock and latch mechanism 17, which would be difficult for an infant but easy for an adult to operate, is provided to releasably lock gate 9 in the close position as illustrated in FIG. 1.

In preferred embodiments of the invention, both the vertical barrier 5 and gate 9 are comprised of vertical rails 19, spaced apart at regular intervals, yet sufficiently closed together to prevent passage by the infant or animal sought to be restrained. The rails on the vertical barrier 5 are fastened (e.g., welded) into upper and lower horizontal arms 21 and 23 extending laterally from vertical post 7. The rails on gate 9 are likewise fastened to upper and lower horizontal arms 25 and 27. Clamp screws 28 and 30 extending laterally through vertical post 7 are used to tighten closure 1 within vertical sides 3*a* and 3*b* of the passageway.

The locking apparatus 29 is shown fastened to the frame 11, although it will be recognized by those familiar with such closures that the body of the locking mechanism may be attached vertically along the rails 19 or on upper horizontal arm 21 of the vertical barrier itself. Similarly, locking apparatus 29 could be attached to the lower horizontal arm 23 of the vertical barrier with the rail engaging hooks (FIG. 2) engaging the rails of the gate.

Although it is not necessary to practice the invention, preferably two locking apparatus 29, 32 are used. Locking apparatus 32 is mounted to frame 11 along upper horizontal arm 22 and functions as a duplicate of locking apparatus 29. For convenience, explanation shall focus on locking apparatus 29 but will apply likewise to locking apparatus 32.

Figure 2:
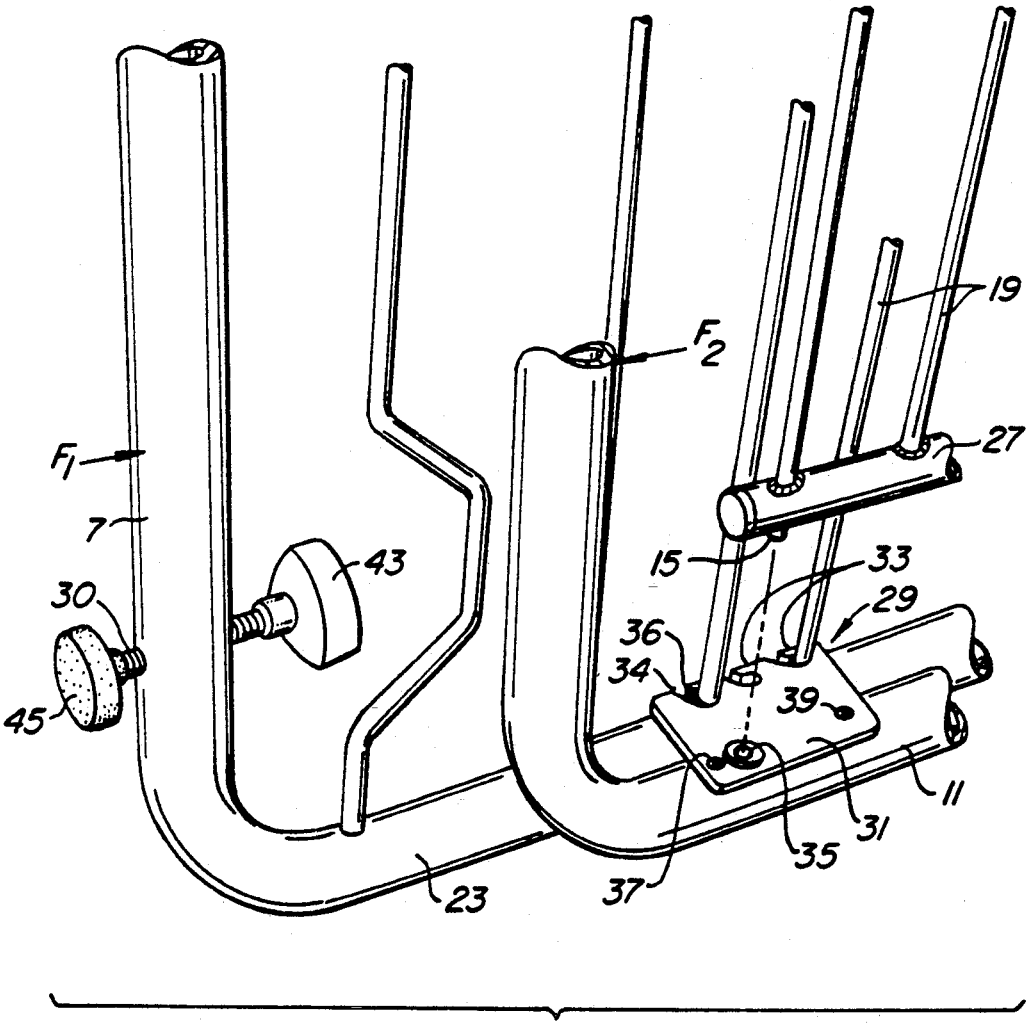
FIG. 2 is a perspective, partially sectioned and exploded view of the locking apparatus shown in FIG. 1.

An enlarged view of the locking apparatus 29 and its interaction with the rails and horizontal arms of the frame and vertical barrier is shown in FIG. 2. Locking apparatus 32 functions in mirror image to locking apparatus 29 but is fastened to upper horizontal arm 22 as previously stated. Locking apparatus 29 includes a body 31 and rail engaging hooks 33 which create slots 34 having internal surface 36 which can receive the rails of the vertical barrier. The body 31 of locking apparatus 29 further includes a bore 35 adapted to receive bottom gate pivot 15 in a secure manner but still allowing the gate to pivot and allow a person to pass through the closure. Body 31 of locking apparatus 29 is securely fastened via screws or bolts 37, 39, it being understood that body 31 could be rotated 180° in a horizontal plane so that body 31 could be screwed or bolted to lower horizontal arm 23 of the vertical barrier while rail engaging hooks 33 receive rails of the gate. Optionally, body 31 need not be fastened to any horizontal arm member but rather fastened to the rails of either the gate or the vertical barrier anywhere between the bottom and top horizontal members of the frame and/or vertical barrier. Likewise for locking apparatus 32.

As illustrated in FIG. 2, rail engaging hooks 33 are preferably evenly spaced on body 31, and there are preferably more rail engaging hooks 33 then there are rails to be engaged so as to provide large variation in the position of the gate in relation to the vertical barrier. Alternatively, there may be less rail engaging hooks 33 than there are rails to be engaged, including the situation of having a single rail engaging hook. These various embodiments are considered within the scope of the appended claims.

The width of the closure is established by horizontal arms 21 and 23 extending laterally from vertical post 7 and horizontal arms 25 and 27 extending horizontally toward vertical post 12 adjacent to side 3*b* of the passageway. Horizontal arm 25 terminates at vertical post 12 when the gate is closed, while horizontal arm 27 preferably does not engage vertical post 12, although the embodiment where both horizontal arms 25 and 27 engage post 12 would be an acceptable variation as long as a child or animal could not open the gate. As can be seen in FIG. 1, frame 11, including vertical post 12, virtually encloses the entire gate except for the portion of horizontal arm 25 near latch and lock 17, providing a very strong, secure closure, even when the closure is at full width.

Another important feature is that the combined length of the arms 21, 25 and frame 11 may be adjusted by removal of rails from the rail engaging hooks 33 (FIG. 2) in locking apparatus 29, 32, and upon slight rotation of vertical barrier horizontal arm 21. The engaging hooks 33 can thus be positioned to engage a different set of rails of the vertical barrier 5. At smaller widths, the rails of gate 9 and those of barrier 5 overlap when the gate is closed. At the greatest width, on the other hand, there is no overlap in the rails of both the gate and the barrier to form a continuous arrangement of regularly spaced rails. Latch 17 (FIG. 1) is positioned at the upper end of the exposed edge of the gate.

In the preferred constructions, gate 9 and barrier 5 are of approximately the same height so as to form a continuous barrier when the gate is closed and the width of the closure locked. Further, in most applications, the vertical barrier 5 will be of substantially lesser width than the gate 9. In general, however, any combination of dimensions may be used.

The closure is rigidly secured in the passageway by conventional means. A particular convenient construction is shown in FIG. 1. A pair of clamp screws 28, 30 pass laterally through one of the two posts 7, 12, the clamp screws extending in the direction of the passageway side wall 3*a*. Each screw has a knob 43 shaped for easy hand turning. A pressure pad 45 is loosely attached to the other end of each clamp screw for compression against the passageway side wall. Gripping pads 47, 49 are secured to one of the two posts 7, 12 to prevent lateral slippage along the wall surface. The closure is thus installed in a passageway by first selecting an appropriate spacing of lateral arms 21, 23 and frame 11 to fill almost the entire width of the passage, securing some of the rails of the vertical barrier 5 to frame 11 by inserting rails 19 into engagement hooks 33 (in both locking apparatus 29 and 32 if both are used in the particular embodiment), and placing the assembled closure in the passageway and turning the clamp screws 28, 30 by their respective knobs to firmly compress the pressure pads 45 and gripping pads 47, 49 against the walls.

When the vertical barrier 5 is comprised of vertical rails, as shown in the drawings, the rail 51 closest to the side wall 3*a* may be shaped as shown in FIG. 1 to provide clearance for the clamp screw knobs, permitting the clamp screws a wide degree of freedom in the lateral direction and adding to the variability of passage width in which the closure may be used. Thus, by tightening the clamp screws 28, 30, arms 21 and 23 of vertical barrier 5 are forced in the direction shown as $F_1$ in FIG. 2 while the frame 11 is forced in the direction shown as F2 (i.e., in opposite directions) to securely and directly clamp the rails of the vertical barrier to the frame 11 via the locking apparatus 29.

The foregoing description is offered for illustrative purposes only. Numerous modifications and variations will be readily apparent to those skilled in the art, while still falling within the spirit and scope of the invention as claimed hereinbelow.

What is claimed is:

1. A locking apparatus for use in locking an adjustable width closure to one of a plurality of widths, said closure adapted to be mounted across a passageway with clamp means, the closure including a vertical barrier extending laterally from a first vertical post positioned adjacent one vertical side of the passageway, and a gate extending laterally within a frame, the frame including a second vertical post positioned adjacent a second vertical side of the passageway, said vertical barrier and gate each having a plurality of vertical rails, the locking apparatus comprising a body attached to the closure and having a plurality of means for engaging at least one of said rails, said means extending from the body substantially perpendicular to said rails and engaging at least one of said rails of one of said vertical barrier when the closure is mounted in the passageway by tightening the clamp means, the body fixed in spaced relation to said rails of said vertical barrier and to said frame by attachment means.

2. A locking apparatus in accordance with claim 1 wherein the vertical barrier further comprises upper and lower horizontal arms extending laterally from said first vertical post and wherein said frame further comprises upper and lower horizontal arms and a third vertical post connecting the upper and lower arms of the frame, and wherein said body of said locking apparatus includes a pivot mount configured to provide pivotal engagement with said gate.

3. A locking apparatus in accordance with claim 2 wherein said means for engaging at least one of said rails comprises a plurality of hooks, the hooks each defining slots to engage a longitudinal portion of one of said rails, the slots each having an internal surface parallel to the vertical axis of the rails, the internal surface extending substantially circumferentially around one of said plurality of rails of one of said vertical barrier.

4. A locking apparatus in accordance with claim 2 wherein said means for engaging at least one of said rails comprises a single hook, the hook defining a slot to engage a longitudinal portion of one of said rails, the slot having an internal surface parallel to the vertical axis of the rail, the internal surface extending substantially circumferentially around one of said plurality of rails of one of said vertical barrier.

5. A locking apparatus in accordance with claim 2 wherein said locking apparatus body is affixed to at least one of the rails of one of said vertical barrier at a vertical position between the upper and lower horizontal arms of the frame and barrier.

6. A removable adjustable width closure for mounting across a passageway, the passageway having a first vertical side and a second vertical side, the closure comprising:

a first vertical post positioned adjacent the first vertical side of the passageway;

a second vertical post positioned adjacent the second vertical side of the passageway;

a vertical barrier extending laterally from the first vertical post and including a plurality of vertical rails, a first clamping means and a second clamping means, said first and second clamping means each having a clamp screw threadably engaged with said first vertical post, each said clamp screw coupled with a first and second gripping pad at one end respectively and a first and second knob at an opposite end respectively, the threadable engagement providing adjustable extension of the gripping pad away from the first vertical post towards the first vertical side of the passageway;

a frame laterally extending from said second vertical post, said frame including an upper horizontal arm and a lower horizontal arm and at least one gripping pad secured to said second vertical post and configured to provide a surface for frictional engagement with said second vertical side of the passageway;

a gate having an upper horizontal arm, a lower horizontal arm and a plurality of substantially vertical rails coupling said upper horizontal arm to said lower horizontal arm, said gate including a gate pivot and a latch mechanism; and a locking means having a body, at least one rail engaging hook, means for attaching said locking apparatus to the frame, and a pivot bore configured to receive said gate pivot, wherein the rail engaging hook defines a slot and includes an internal surface, said slot and internal surface configured to removably engage a rail of said vertical barrier to secure the frame in a substantially fixed position relative to the vertical barrier.

7. The closure of claim 6, wherein said locking means includes a first locking apparatus and a second locking apparatus, wherein said first locking apparatus is secured to the lower horizontal arm of the frame and said second locking apparatus is secured to the upper horizontal arm of the frame, and wherein said gate includes a first gate pivot mount extending downwardly from the lower horizontal arm and a second gate pivot mount extending upwardly from the upper horizontal arm, said first pivot mount pivotally engaging a first pivot bore in said first locking apparatus, and said second pivot mount pivotally engaging a second pivot bore in said second locking apparatus, wherein the engagement between the first pivot mount and the first pivot bore and the second pivot mount and the second pivot bore provides pivotable engagement between the gate and the frame to thereby allow the gate to swing away from the longitudinal axis of the frame, the latch configured to engage with the frame to secure the gate in a position substantially parallel to the longitudinal axis of the frame.

* * * * *